US010019882B2

(12) United States Patent
Hatanaka et al.

(10) Patent No.: US 10,019,882 B2
(45) Date of Patent: Jul. 10, 2018

(54) PROTECTIVE EQUIPMENT COMPRISING ALARM SYSTEM

(71) Applicant: TEIJIN LIMITED, Osaka-shi, Osaka (JP)

(72) Inventors: Yuko Hatanaka, Osaka (JP); Tomoki Nakamura, Osaka (JP)

(73) Assignee: TEIJIN LIMITED, Osaka (JP)

( * ) Notice: Subject to any disclaimer, the term of this patent is extended or adjusted under 35 U.S.C. 154(b) by 0 days.

(21) Appl. No.: 15/517,683

(22) PCT Filed: Oct. 16, 2015

(86) PCT No.: PCT/JP2015/079254

§ 371 (c)(1),
(2) Date: Apr. 7, 2017

(87) PCT Pub. No.: WO2016/060222

PCT Pub. Date: Apr. 21, 2016

(65) Prior Publication Data

US 2017/0330437 A1 Nov. 16, 2017

(30) Foreign Application Priority Data

Oct. 16, 2014 (JP) ..... 2014-211707

(51) Int. Cl.
*G08B 21/02* (2006.01)
*G08B 21/04* (2006.01)
(Continued)

(52) U.S. Cl.
CPC ..... *G08B 21/0453* (2013.01); *A41D 31/0027* (2013.01); *A62B 17/003* (2013.01)

(58) Field of Classification Search
CPC .. A41D 2400/22; A41D 31/0027; A61B 5/02; A61B 5/021; A61B 5/02125;
(Continued)

(56) References Cited

U.S. PATENT DOCUMENTS 5,973,602 A 10/1999 Cole, III et al.
9,396,643 B2 * 7/2016 He ..... G06F 21/00
(Continued)

FOREIGN PATENT DOCUMENTS

JP 2004-027417 A 1/2004
JP 2004-030180 A 1/2004
(Continued)

OTHER PUBLICATIONS

International Search Report for application No. PCT/JP2015/079254 dated Jan. 12, 2016.
(Continued)

*Primary Examiner* — Van Trieu
(74) *Attorney, Agent, or Firm* — Sughrue Mion, PLLC

(57) ABSTRACT

A protective equipment with an alarm system capable of ensuring safety, workability and convenience, as well as alerting to a life-threatening danger such as heatstroke is provided. The alarm system includes (i) a sensor for detecting a biometric information of a wearer of the protective equipment; (ii) a means for determining if the biometric information which is detected by the sensor reaches a threshold value; (iii) a means for alarming an elevated risk based on an instructions from the means (ii); (iv) a means for transmitting an alarm when the means (iii) is activated; and (v) a means for controlling the means (iii) and (iv).

19 Claims, 7 Drawing Sheets

(51) Int. Cl.
*A62B 17/00* (2006.01)
*A41D 31/00* (2006.01)

(58) Field of Classification Search
CPC ..... A61B 5/02416; A61B 5/11; G08B 21/02; G08B 21/04; G08B 21/043; G08B 21/0435; G08B 21/0438; G08B 21/0446; G08B 21/0453; G08B 21/0469; A62B 17/00; A62B 17/003; A62B 17/005; A62B 17/006
See application file for complete search history.

(56) References Cited

U.S. PATENT DOCUMENTS

| | | | | |
|---|---|---|---|---|
| 2010/0054300 | A1 | 3/2010 | Tsai | |
| 2010/0076337 | A1 | 3/2010 | Medina | |
| 2013/0040523 | A1 | 2/2013 | Takahashi et al. | |
| 2014/0203938 | A1 | 7/2014 | McLoughlin et al. | |
| 2015/0112159 | A1* | 4/2015 | He | G06F 21/00 600/301 |
| 2017/0203540 | A1* | 7/2017 | Colatruglio | B32B 5/245 |

FOREIGN PATENT DOCUMENTS

| | | | |
|---|---|---|---|
| JP | 2008-31618 | A | 2/2008 |
| JP | 2008-138336 | A | 6/2008 |
| JP | 2009-108451 | A | 5/2009 |
| JP | 2010-255124 | A | 11/2010 |
| JP | 2011-516110 | A | 5/2011 |
| JP | 2012-187127 | A | 10/2012 |
| JP | 2013-022217 | A | 2/2013 |
| JP | 2013-048812 | A | 3/2013 |
| WO | 2011/010483 | A1 | 1/2011 |
| WO | 2012/137556 | A1 | 10/2012 |

OTHER PUBLICATIONS

Communication dated Feb. 27, 2018 from the Japanese Patent Office in counterpart Application No. 2016-554125.
Communication dated Apr. 19, 2018 from the European Patent Office in counterpart Application No. 15850990.1.

* cited by examiner

FIG. 4

| worker | determination cycle (sec) | time | temperature inside clothes (°C) | records | determination |
|---|---|---|---|---|---|
| | | | | alarming level | |
| 1a | 10 | 13:50:30 | 32 | | normal |
| | | | 38 | | |
| 1a | 10 | 13:50:40 | 32 | | normal |
| | | | 38 | | |
| | | | | | normal |
| | | | | | |

[FIG. 5]

| worker | time | temperature in clothes (°C) | normal value | alarming level | determination |
|---|---|---|---|---|---|
| 1a | 13:50:30 | 32 | | | normal |
| | | 38 | | | |

[FIG. 6]
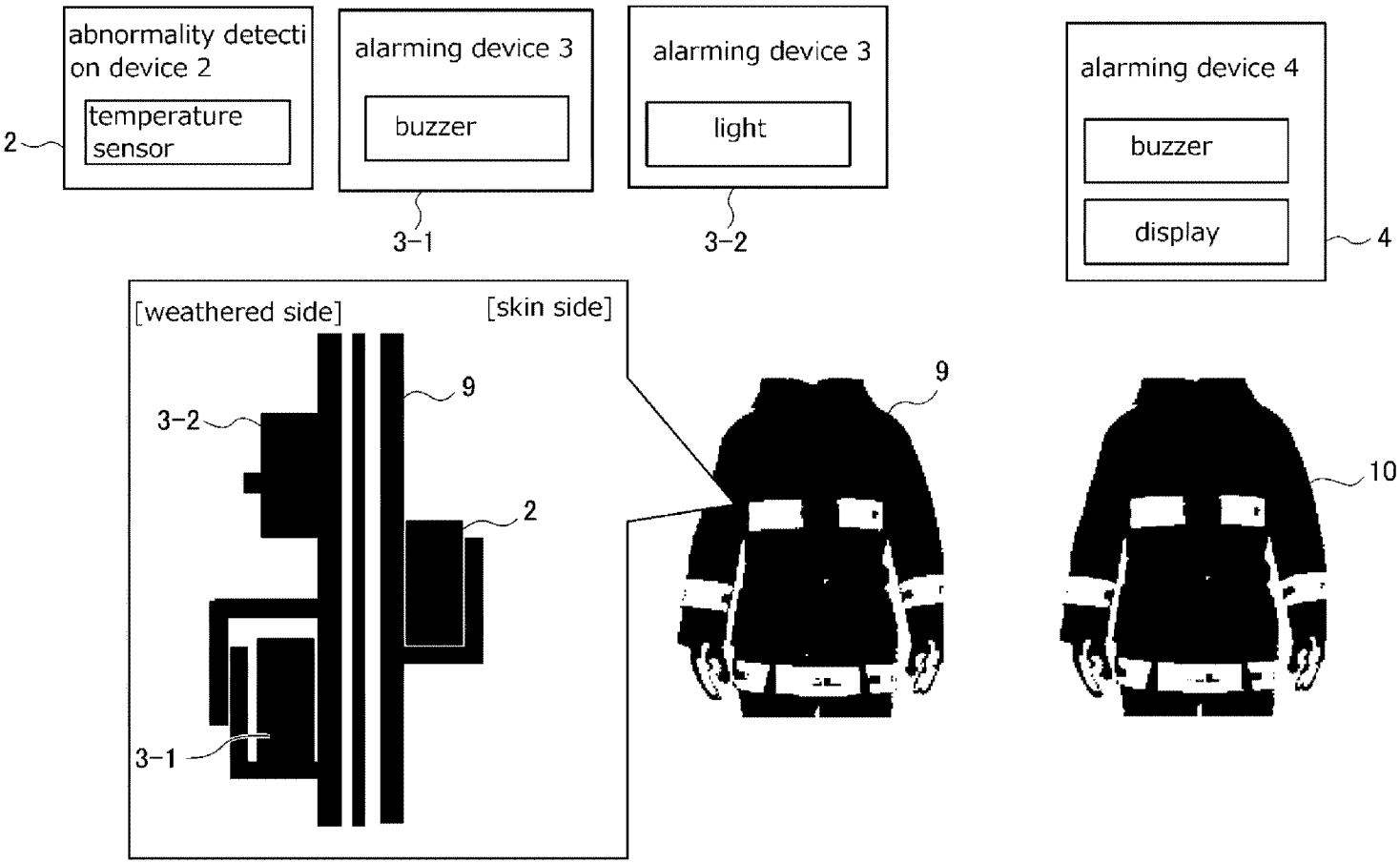

[FIG. 7]
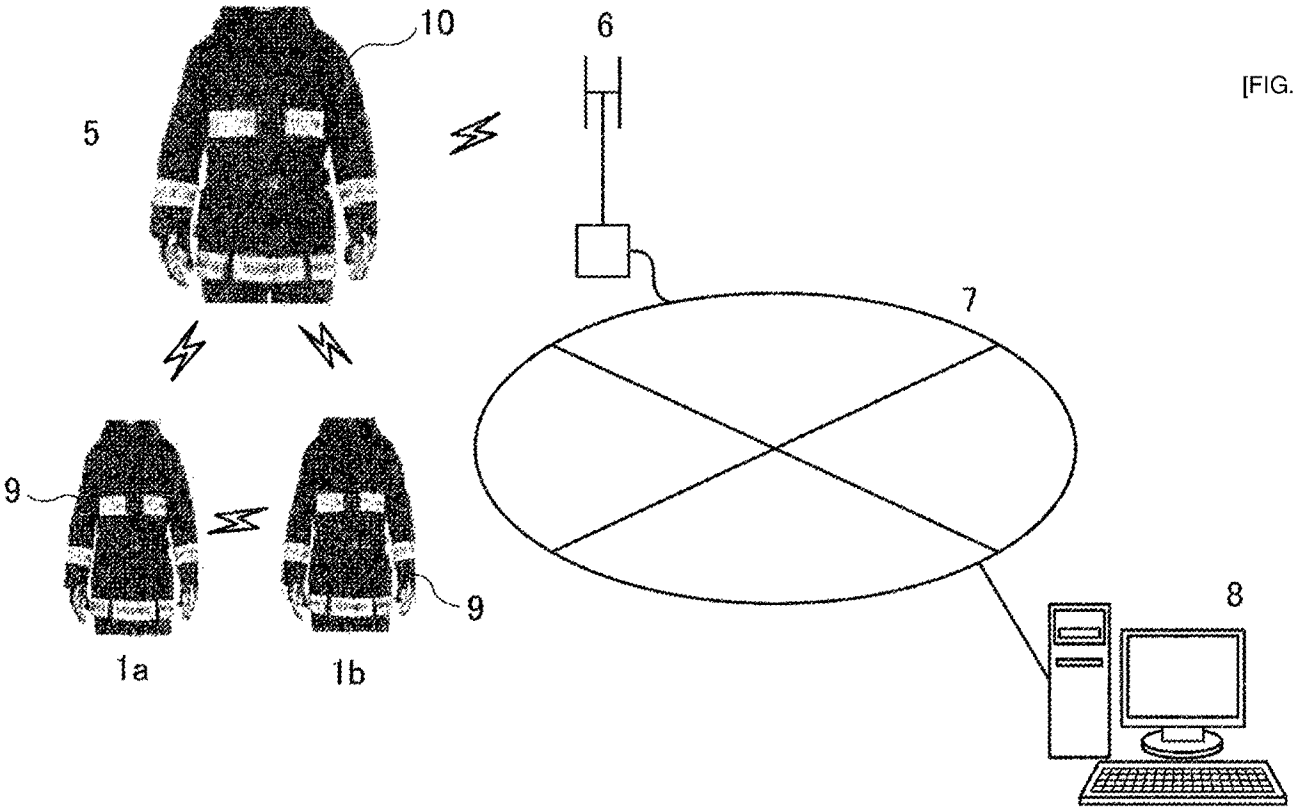

PROTECTIVE EQUIPMENT COMPRISING ALARM SYSTEM

TECHNICAL FIELD

The present invention relates to protective equipment with an alarm system capable of ensuring safety, workability and convenience, as well as alerting to life-threatening dangers such as heatstroke.

BACKGROUND ART

For personnel working in harsh environments, monitoring their physical condition during their work is extremely important. For example, heat spasms or heat flares which are also known as heatstroke may lead to life-threatening dangers when the condition occurs in the field and accompanied by dangerous work. One particular example relates to firefighting activities, firefighters are required to wear protective equipment such as a fireproof suits in addition to carrying various pieces of equipment such as a tank and work in high temperature environments close to flames. Furthermore, because of the nature of the fireproof suits, heat is prone to stay in the fireproof suits and firefighters are thus more likely to be at risk for heatstroke. Moreover, firefighters are more likely to engage in activities that can push them beyond their physical limits. In light of the above, there has been a need for detecting and reporting when the firefighters are at a high risk of heatstroke.

One prior art document discloses, for example, an ear plug-type alarm system as proposed in Patent Document 1. However, because it is an ear plug-style system, there are inherent problems most notably of which is that it interferes with the hearing of the firefighters. Furthermore, with regard to firefighting activities, the ear plug-type alarm system may not be durable enough for such a harsh environment.

In Patent Document 2, a method has been proposed in which information detected by a temperature sensor is transmitted to an external module via a communication means, and the external module determines whether the risk of heatstroke. However, this method also contains problems particularly that the alarm system may not operate normally if the firefighters are in a building or in a basement and communication cannot be ensured.

A system for detecting heat stress in firefighting activities has been proposed in Patent Document 3. However, this system is also flawed because heat stress is measured at the head and there is a concern that the firefighter's activities may be hindered. Additionally, the alarm system may not work normally when the head protection equipment is removed.

CITATION LIST

Patent Literature

Patent Document 1: JP2013-048812(A)
Patent Document 2: JP2012-187127(A)
Patent Document 3: JP2004-030180(A)

SUMMARY OF INVENTION

Technical Problem

The present invention has been made in order to overcome the above-described drawbacks and problems, and provides a protective equipment with an alarm system capable of ensuring safety, workability and convenience, as well as alerting a worker to life-threatening dangers such as heatstroke.

Solution to Problem

The present invention has been made in order to overcome the above drawbacks and problems, and provides a protective equipment with an alarm system capable of ensuring safety, workability and convenience, as well as alerting a worker to a life-threatening danger such as a heatstroke.

Solution to Problem

As a result of earnest study and investigation, the present inventors have found that by using a protective equipment with an alarm system and through communication between these alarm systems, it is possible to ensure safety, workability and convenience, as well as to alert a worker to a risk of a heatstroke or the like. The present invention has been completed through further earnest study and investigation on the basis of the above finding.

In one aspect, the present invention provides a protective equipment with an alarm system. The alarm system has (i) a sensor for detecting biometric information of a wearer of the protective equipment; (ii) a determination means for determining if the biometric information detected by (i) the sensor reaches a threshold value; (iii) an alarming means for alerting to an elevated risk based on instructions from (ii) the determination means; (iv) a transmitting means for transmitting an alarm when (iii) the alarming means is activated; and (v) a controlling means for controlling (iii) the alarming means and (iv) the transmitting means.

(i) The sensor may be a temperature sensor for detecting an inner temperature of the protective equipment.

In another aspect, the present invention provides a protective equipment with an alarm system. The alarm system has (A) a receiving means for receiving an alarm which is transmitted by (iv) the transmitting means as recited in claim 1; (B) an alarming means; and (C) a controlling means for controlling (A) the receiving means and (B) the alarming means.

In afore-mentioned aspects of the present invention, the alarming means (i.e., means (iii) and/or means (B)) may be based on a sound. A display means for displaying that at least one of (i) the sensor, (ii) the determination means, (iii) the alarming means, (iv) the transmitting means, (A) the receiving means and (B) the alarming means is operating normally may be further provided. The protective equipment may be formed of a multi-layer fabric. (i) The sensor may be disposed on a skin-side surface of an innermost layer or between layers of the multi-layer fabric. A heat shielding property (HTI24) of a fabric constituting the protective equipment may be 13 seconds or more as measured in accordance with ISO 9151. A water repellency of an outermost surface of a fabric constituting the protective equipment may be Grade 3 or above as measured by a spray method defined in JIS L 1092. A fabric constituting the protective equipment may have a shrinkage ratio of 5% or below according to ISO 11613-1999. The protective equipment may be a protective suit for a firefighting use. A fabric constituting the protective equipment may contain aramid fibers.

Advantages of Invention

The present invention provides protective equipment with an alarm system capable of ensuring safety, workability and convenience, as well as alerting a worker to life-threatening danger such as heatstroke.

BRIEF DESCRIPTION OF DRAWINGS

FIG. 4 is a diagram showing exemplary records displayed in an abnormality detection device 2 in accordance with the present invention.

FIG. 5 is a diagram showing an exemplary display of the second alarming device 4 in accordance with the present invention.

FIG. 6 is a view schematically showing a protective suit obtained in Example 1.

FIG. 7 is a diagram showing an alarm system connected to a network.

DESCRIPTION OF EMBODIMENTS

Figure 1:
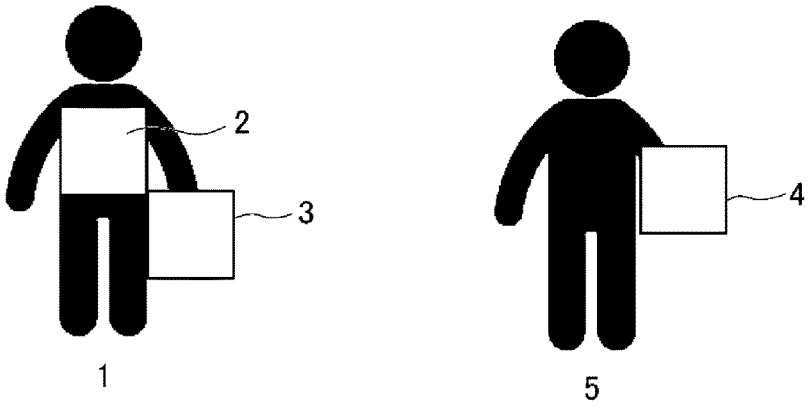
FIG. 1 is a diagram depicting an exemplary embodiment of the present invention.

Hereinafter, the embodiment of the present invention will be described based on an example in which a heatstroke alarm system is applied to a protective suit.

In a protective suit for workers with a heatstroke alarm system, which is an example of the embodiment, the heatstroke alarm system may include a sensor that detects the biometric information of a wearer, a determination means for determining that the biometric information which is detected by the sensor reaches a threshold and the risk of heatstroke is increased, an alarming means for alerting that the risk of heatstroke is increased, and a transmitting means for transmitting an alarm when the alarming means is activated, as well as a controlling means for controlling the alarming means and the transmitting means. Such a protective suit is preferably used as, for example, a fire protective suit (i.e., fireproof suit) for firefighters.

In this regard, it is preferable that the sensor for detecting the biometric information is a temperature sensor for detecting the temperature inside the protective suit. However, other types of sensors can also be used including: a temperature sensor for detecting the temperature outside the protective suit, a humidity sensor for detecting humidity inside or outside the protective suit, a sensor for detecting oxygen concentration in blood, a sensor for detecting a heartbeat, a sensor for detecting electrocardiogram waves, a sensor for detecting a pulse, a sensor for detecting pulse waves, a sensor for detecting blood pressure, a sensor for detecting vascular flow, a sensor for detecting body movement as well as the presence/absence of body movement, a sensor for detecting a body position, a sensor for detecting skin temperature, a sensor for measuring tympanic membrane temperature, a sensor for measuring rectal temperature, a sensor for detecting changes in skin color, a sensor for detecting sweat, a sensor for detecting the number, speed, and depth of breaths, a sensor for detecting brain waves, a sensor for detecting pupil dilation, a GPS for detecting location, or the like. It is expected that the accuracy of detection will improve with the combination of multiple sensors because there are a variety of symptoms of heatstroke.

While the sensor for detecting the biometric information will hereinafter be referred to as a temperature sensor for detecting the temperature inside the protective suit, the sensor used is not limited to such a temperature sensor.

Furthermore, a supervisor protective suit is a protective suit with the heatstroke alarm system, which has a receiving means for receiving an alarm sent from other workers (i.e., the transmitting means of the protective suit for firefighters), an alarming means, and a controlling means for controlling the receiving means and the alarming means. Such a protective suit is preferably used as, for example, a protective suit for captains of the fire brigade.

For example, if the firefighters (i.e., the members) and the captain of the fire brigade respectively wear such protective suits equipped with the heatstroke alarm system, they will be notified of the risk of heatstroke while ensuring safety, workability, and convenience.

The heatstroke alarm system using a temperature sensor is explained below while referring to the figures (Please also refer to figures other than those expressly indicated figure(s)).

Referring to FIG. 1, the heatstroke alarm system comprises an abnormality detection device 2*a*, 2*b*, 2*c* (2)(hereinafter, simply referred to as an "abnormality detection device 2" unless particularly distinguished) which is situated inside and/or outside a worker's protective suit 1*a*, 1*b*, 1*c* (1) (hereinafter, simply referred to as a "worker 1" unless otherwise stated) (i.e., a subject), a first alarming device 3 and a second alarming device 4 which is carried by a supervisor 5 who is someone other than the worker 1.

Figure 2:
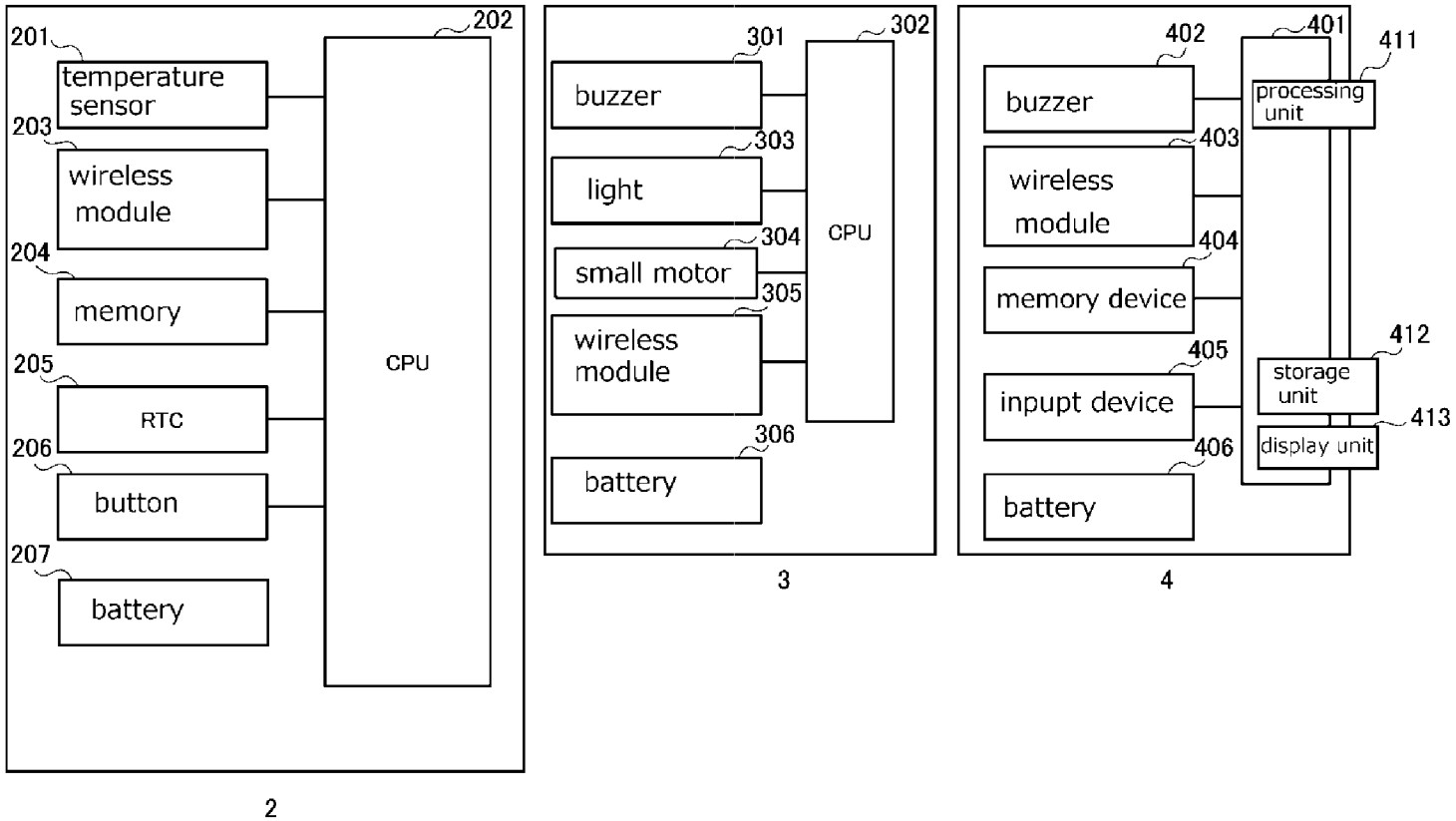
FIG. 2 shows an example of a system that can be used in the present invention.

Referring to FIG. 2, the abnormality detection device 2 includes a temperature sensor 201, a CPU (i.e., a processing means) 202, a wireless module 203, a memory (i.e., a storage means) 204, an RTC (i.e., Real Time Clock) 205, a button 206 and a battery 207. In addition, the first alarming device 3 may include a buzzer (i.e., an abnormality notification means) 301, a CPU (i.e., a processing means) 302, an optionally a small-sized light 303 and a small-sized motor (i.e., an abnormality notification means) 304. The CPU 202 of the abnormality detection device 2 and the CPU 303 of the alarming device may be the same. The system may include a plurality of the first alarming devices 3 per one abnormality detection device 2. By including the plurality of first alarming devices 3 in the system, an individual equipped with the system can be alerted to an alarm at an early stage. The temperature sensor 201 is a means (i.e., a sensor) for measuring the temperature inside the clothes of the worker 1. Hereinafter, the data acquired by the temperature sensor 201 may be referred to as "sensor data". The CPU 202 performs various arithmetic processes using the memory 204. The wireless module 203 is a means for wireless communication with an external device (e.g., the first alarming device 3 and/or the second alarming device 4). The memory 204 is a storage means and can be realized by the use of, for example, RAM (Random Access Memory), ROM (Read Only Memory), HDD (Hard Disk Drive), or the like. The RTC 205 as a means for measuring time can be realized by the use of, for example, a dedicated chip, and can be activated by the power supply from a built-in battery even while the battery is not in operation. The battery 207 is a power supply means, and can be realized by the use of, for example, a storage battery. The button 206 is an input means which is operated (i.e., pressed) by the worker 1. By disposing a CPU 202 as a means for determining whether or not the temperature detected by the temperature sensor 201 is equal to or greater than a threshold value, as well as, the temperature sensor 201 inside the same unit (i.e., the abnormality detection device 2), then even in the case where the wireless module 203 is faulty, or wireless communication is unavailable, the risk of heatstroke can still be detected, determined, and warned.

Further referring to FIG. 2, the first alarming device 3 includes a CPU 302, a buzzer 301, and a battery 306. The buzzer 301 is an alarming means for generating a buzzer sound based on instructions from the CPU 302. The light 303 and the small-sized motor 304 are both alarming means for generating light and vibration, respectively, based on the CPU 302 instructions. The alarm can also be transmitted in the form of light or vibration in addition to the sound of the buzzer 301 so that the worker 1 can be notified by the alarm more quickly and with more certainty. A wireless module 305 is a means for wireless communication with the abnormality detection device 2 and/or an external device (i.e., the second alarming device 4). The battery 306 is a power supply means, and can be realized by, for example, a storage battery.

Again referring to FIG. 2, the second alarming device 4 includes a panel-type computer 401, a buzzer 402, a wireless module 403, a memory device 404, an input device 405, and a battery 406. The panel-type computer 401 is a computer in which a processing unit 411 including a CPU or the like, a storage unit 412 including RAM, ROM, HDD or the like, a display unit 413 that may be a liquid crystal display with a touch panel or the like are integrally incorporated. With the panel-type computer 401, an operator can perform an intuitive manual operation on the display unit 413. The buzzer 402 is an alarming means for generating a buzzer sound based on instructions from the panel-type computer 401. The wireless module 403 is a means for wireless communication with an external device (i.e., the first alarming device 3). The memory device 404 is a detachable storage medium and can be realized by, for example, a flash memory. The battery 406 is a power supply means and can be realized by, for example, a storage battery.

Additionally, the antenna of the wireless module 203, 305, 403 can also be formed integrally with the protective suit by means of conductive fibers or the like. For example, if the antenna is formed on the outer surface of the protective suit, even if the abnormality detection device 2, the first alarming device 3, and the second alarming device 4 are disposed inside the protective suit, wireless communication therebetween can nonetheless be made without being disturbed by the protective suit. For this reason, fabrics with high electromagnetic wave absorption may be used for the protective suit. While the antenna may be formed integrally with the protective suit by means of the conductive fibers, conductive material may be alternatively vapored or printed on the protective suit. Alternatively, an antenna which is formed of a flexible substrate in advance may be coupled to the protective suit.

Next, an example of data being stored in the memory 204 of the abnormality detection device 2 will be described. Referring to FIG. 4, the data stored in the storage section is composed of five columns and will be described in order from the left to the right.

"Worker" indicates the identifier of a worker 1. "Determination cycle (sec)" is a cycle (in seconds) that the abnormality detection device 2 periodically collects data with the temperature sensor 201 and stores the data in the memory 204. Further, the determination cycle (sec) is a cycle (in seconds) that the abnormality detection device 2 compares the data with a predetermined threshold value for determining the abnormality of the body of the worker 1. For example, there can be a cycle of 60 seconds as a long cycle and a cycle of 10 seconds as a short cycle. As part of this example, the time at which the sensor data are collected as needed is the time measured by the RTC 205.

Regarding the "temperature inside clothes (° C.)", the "records" signified in the upper portion of the cell indicates the temperature inside the clothes of the worker 1 and indicative of the biometric information which is acquired by the temperature sensor 201 at the indicated time. The "warning level" in the lower portion of the cell indicates the first temperature threshold value and in this example is set at 38° C. in FIG. 4. The set threshold value for various types of biometric information may be set to either an absolute value or a relative value. If the relative value is set as the threshold value, the risk of heatstroke can be reliably detected at an earlier stage by accounting for the individual differences of the worker 1 and the worker's daily physical condition fluctuation. Further, for one determination item (for example, the body temperature), the relative threshold value and the absolute threshold value may be used in combination. In addition, the determination as to whether each item is abnormal or not may be made based on the above described date has changed or the changing rate of the data (i.e., the changed amount over a given unit of time).

Next, an example of a screen displayed on the display unit 413 of the second alarming device 4 will be described. As shown in FIG. 5, on the display unit 413 which is the screen for the supervisor, the information for identifying the worker is displayed in the leftmost column, and the items of "temperature inside clothes" and "determination" are displayed in the columns to the right of the column "time".

Figure 3:
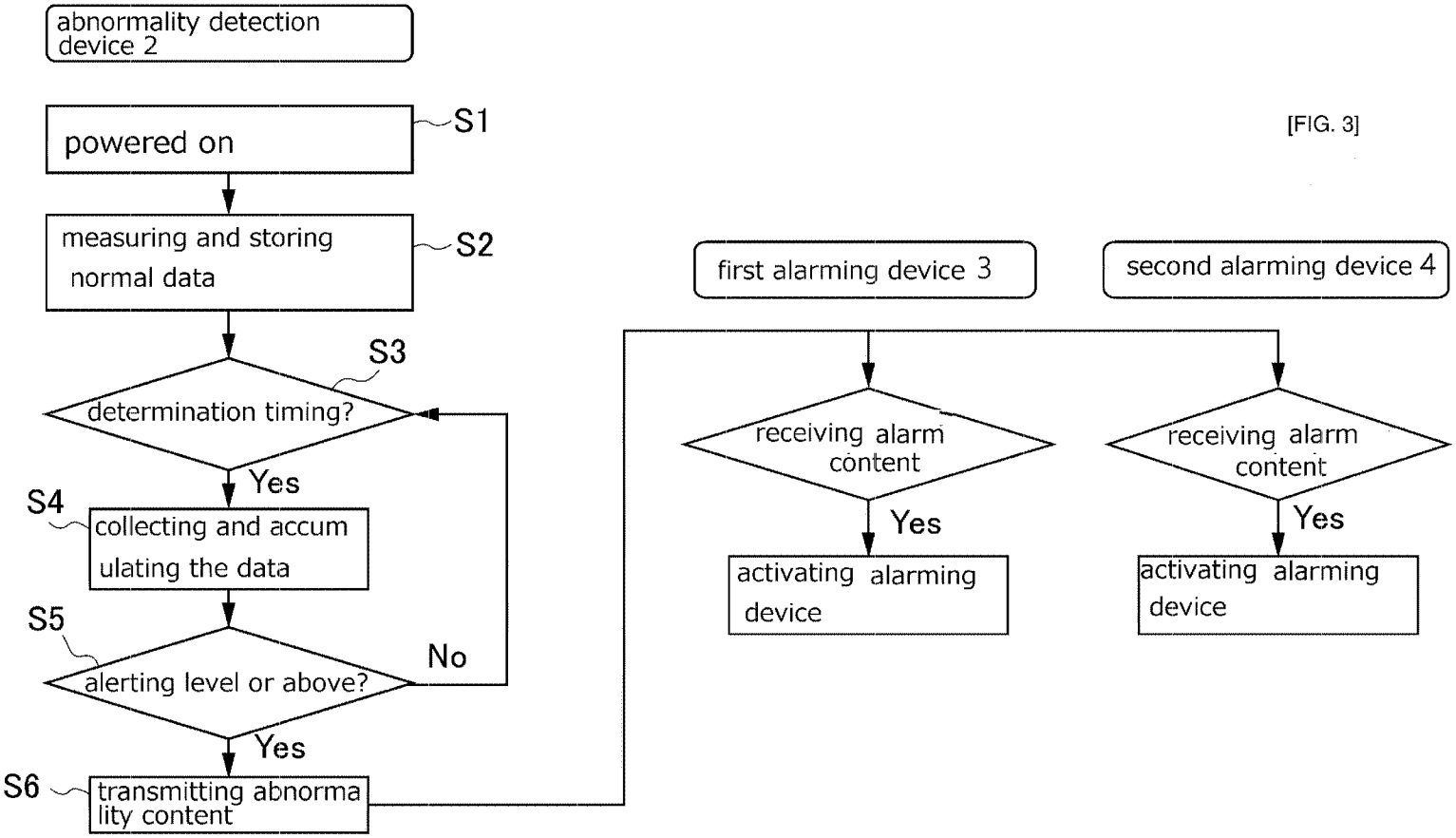
FIG. 3 shows an example of a flowchart that can be used in the present invention.

Next, the processing flow of the heatstroke alarm system will be described. It should be noted that although there may be a plurality of abnormality detection devices 2, it is assumed for the purposes of this example that there is a single abnormality detection device 2 in order to simplify the illustration. Referring to FIG. 3 (see other figures as appropriate), when the abnormality detection device 2 is powered on by the worker 1 (step S1), the sensor 201 acquires an initial data set which sets the baseline for the normal sensor data before work and stores the acquired baseline sensor data in the memory 204 (step S2). Thereafter, the worker 1 begins working. Next, the CPU 202 of the abnormality detection device 2, as the determination means, determines whether or not the determination timing based on the determination cycle occurs (step S3), and if the determination timing has occurred ("Yes"), it proceeds to step S4.

In step S4, the CPU 202 of the abnormality detection device 2 collects the sensor data which is received from the sensor 201 and compiles the data in the memory 204. At the same time, the CPU 202 of the abnormality detection device 2 may check the voltage of the battery 207 and/or the status of communication with the first alarming device 3 or the second alarming device 4. Next, the CPU 202 of the abnormality detection device 2, as the determination means, determines whether or not the determination item is equal to or higher than the alarming level (i.e., whether "determination" item is "abnormal(alarming)") based on the sensor data collected in the previous step S4 (step S5). If "Yes", the process proceeds to step S6. If "No", the process returns to step S3. In step S6, the CPU 202 of the abnormality detection device 2 notifies the first alarming device 3 of the alarm content (see FIG. 3).

Upon receiving the alarm contents from the abnormality detection device 2, the first alarming device 3 activates the alarming means. Specifically, for example, by sounding the buzzer 301, the worker 1 is notified of the abnormality. At the same time, the small-sized motor 304 may be activated to generate a vibration. The worker 1 can immediately recognize the occurrence of an abnormal reading based on the vibration which is generated by the small-sized motor 304 even in aloud environment in which the noise of the surrounding environment makes the sound of the buzzer 301 difficult to hear. In this manner, the heatstroke alarm system in this embodiment can reliably detect the risk of heatstroke of the worker 1 by virtue of the abnormality detection device 2 and can reliably respond to the abnormal body readings of the worker 1 by directly notifying the worker 1 of the alarm content by means of a sound generated by the alarming means, i.e. the buzzer 301, a vibration generated by the small-sized motor 304 or the like. At least one abnormality detection device 2 and at least one first alarming device 3 are given to the worker. In an alternative embodiment, it is desirable that the CPU of the abnormality detection device 2 and the CPU of the first alarming device 3 are the same. In this case, even in the event that wireless communication between the first alarming device 3 and the second alarming device 4 is not reliably connecting, the abnormal body readings of the worker 1 can be accurately detected and the worker 1 can still be directly notified of his/her abnormal readings.

In this way, the heatstroke alarm system of the embodiment can reliably detect the abnormal body readings of the worker 1 such as in the case of heatstroke and reliably respond to the abnormal body readings of the worker 1 by directly notifying the worker 1 of the alarm in the form of a sound generated by the buzzer 301, a light emitted by the light 303, a vibration generated by a small-sized motor 304 or the like. In other words, even in a situation in which the wireless communication between the first alarming device 3 and the second alarming device 4 is not reliably connecting, the abnormal body readings of the worker 1 can still be reliably detected and the worker 1 can be notified of his/her abnormal readings.

In addition to notifying the worker 1 of his/her abnormal body readings, the abnormality detection device 2 may wirelessly transmit the message of the abnormality (i.e., alarm content or warning content) to a remote second alarming device 4 so that the supervisor 5 can also be made aware of the abnormal readings on the display of the second alarming device 4 and can then take appropriate measures.

Furthermore, the threshold value for the determination of the abnormal readings for each item is not necessarily a common value for all workers 1, and instead the threshold value for the determination of abnormal readings for each item may be set to an original value for each worker 1 based on his/her personal biometric information (i.e., a normal value) which is obtained when the abnormality detection device 2 is powered on. As a result, the risk of heatstroke can be reliably detected at an earlier stage and false alarms can be reduced.

Further, the abnormality detection device 2 may reduce battery 207 usage by transmitting a wireless signal only when it is determined that an abnormal body reading of the worker 1 has occurred, except for periodical transmission of the sensor data which are achieved by the sensor. In addition to the temperature sensor which is disposed of inside of the clothing, another sensor for achieving the biometric information of the ambient environment such as a heartbeat sensor, a temperature sensor, a humidity sensor, an acceleration sensor, a perspiration sensor, a blood pressure sensor or a combination thereof may be used. Moreover, these sensors need not be integrated into the abnormality detection device 2 and may be configured to transmit predetermined biometric information to the abnormality detection device 2.

Further, even in a case where the abnormality detection device 2 determines that the body readings of the worker 1 are abnormal, the worker 1 may cancel the transmission of the abnormality signal to the second alarming device 4 by pressing the button 206 within a predetermined period of time. However, if the body of the worker 1 is obviously abnormal, such cancellation is inappropriate. For this reason, it is preferable that the cancellation is only able to be made when the abnormal readings do not necessarily occur in the body of the worker 1.

Further, the value of the warning level is not limited to this embodiment, and may be appropriately set by the supervisor 5 based on statistical data or the like. Also, the threshold value may be set to either a warning level or an alerting level.

Although the embodiment has been described with respect to a heatstroke alarm system as an example, the alarm system can be applied not only to heatstroke but also to various dangers for individuals. The protective equipment with the alarm system is not limited to a protective suit and it may be applied to helmets, gloves, boots, watches, headbands or the like.

Furthermore, the alarm system according to the embodiment may be connected to a remote server or the like via a network to accumulate and utilize the information. FIG. 7 shows a system in which the second alarming device 4 which is carried by the supervisor 5 is connected to a remote server 8 via wireless communication with a base station 6 and a network 7 such as through the internet. In FIG. 7, the biometric information, the location information, or the like of the workers 1*a*, 1*b* is obtained by various sensors which are mounted in each of the abnormality detection devices 2, and are transmitted to the server 8 via the second alarming device 4 of the supervisor 5. Instead of or in addition to this, a system in which the first alarming devices 3 of the workers 1*a*, 1*b* are connected to the server 8 via wireless communication with the base station 6 and the network 7 may be considered.

The server 8 may routinely or periodically measure the biometric information such as body temperature, heartbeat, blood pressure, respiration rate or the like of the workers 1*a*, 1*b* using the sensors which are mounted in the abnormality detection device 2, calculate an average value in the daily life for each worker, and set the threshold value for determining the abnormality for each of the workers 1, thereby personalizing the measures for each of the workers 1.

Moreover, if the server 8 routinely or periodically collects the biometric information, it is then easy to notice any changes in the physical condition of the worker 1. For example, if the alarm system according to the embodiment is applied to, for example, a uniform for a bus or taxi driver whose job being responsible for a lot of lives, it becomes possible to notice abnormal body readings at an early stage and take countermeasures.

The normal biometric information of the worker 1 which is collected by the server 8 need not be limited to the biometric information which is obtained by the sensor of the abnormality detection device 2 but rather external information obtained during routine checkups may also be input and used. Based on all of the aforementioned information, a threshold value for the biometric information of each worker 1 may be determined.

Further, if the biometric information and the location information of the worker 1 are managed by the server 8, and, for example, the server 8 is installed in a fire station the position, work environment, etc. for each firefighter can be recognized. Accordingly, the captain of the fire brigade, i.e. the supervisor 5, can be notified that a dangerous situation may soon occur or that there is a firefighter whose biometric information is abnormal by or from the fire department, and thereby the burden on the captain of the fire brigade can be reduced.

Furthermore, by accumulating the position information including the altitude information as well as the biometric information data on the server 8, it is possible to study and analyze the behavior patterns of each worker 1 performing work and the physical condition at that time. For firefighters, Self-Defense Forces, the military, rescue teams, police officers, security guards, workers at construction sites such as construction and civil engineering, etc., the data may be used to improve safety, work efficiency, etc. in future activities or as materials for training or education.

In addition, the biometric information, position information, etc. of the worker 1 could also be displayed in the viewing area of the person or another person's eyeglasses, goggles or the like. Moreover, each sensor, a battery as a power source for the sensor, etc. may have a self-diagnosis function, which may include a calibration function for automatically diagnosing and confirming whether it operates normally based on either a daily test signal or a baseline test signal from just before doing work. If the results of the self-diagnosis are transmitted to the server 8 and accumulated in the server 8, they can be centrally managed as the data for a maintenance plan. Further, it is possible to notify the wearer of the presence or absence of abnormal readings by means of either the alarming device 3, the alarming device 4 or the like, and to stop the worker from working.

It is understood that specific configurations such as the hardware and the flowchart of the alarm system may be appropriately modified without departing from the object of the present invention.

Next, each component will be explained. It is desirable that the temperature sensor for detecting the inner temperature of the protective suit has measurement accuracy of 0.1° C. As a result, the risk of heatstroke can be detected with high accuracy. With regard to the sensor, a thermocouple or a Peltier element may be used. It is desirable that the temperature sensor be disposed between the layers or on the skin-side surface of the innermost layer of the multi-layer fabric. By disposing the temperature sensor close to the body, the thermal environment, a factor in the risk for heatstroke, can be detected. Means other than the temperature sensor need not be disposed between the layers of the multi-layer fabric or on the skin-side surface of the innermost layer and may be disposed on the weathered side of the outermost layer. However, in this case, appropriate waterproof treatment is preferably applied to the means.

The temperature sensors, the alarming means, the transmitting means or the receiving means may be a rectangular parallelepiped or conical solid, or a flexible form. The flexible form may be, for example, plate-like, fibrous, gel-like or the like. The use of a more flexible material renders the activity of the worker less restricted.

The clothing including the multi-layer fabric are suitably used as equipment which also comes equipped with the temperature sensor, the alarming means, the transmitting means or the receiving means. Clothing is constantly worn by the workers during their work and would, therefore, hardly disturb the work and activities of the worker, unlike helmets, earphones, etc. For the above reasons, clothing is ideally suitable for constant monitoring. However, it goes without saying that the present invention never precludes equipping the helmets, earphones, etc. with the temperature sensor, the alarming means, the transmitting means or the receiving means. These temperature sensors, alarming means, transmitting means or receiving means may be distributed at a plurality of locations, thereby reducing or distributing the weight of the entire equipment, and/or improving work efficiency.

Further, by utilizing a multi-layer fabric, it is possible to impart various functions to the clothing which would be difficult for a single-layer fabric to accomplish all at the same time. Examples of the functions may include flame retardancy, heat shielding properties, water repellency, chemical permeability, wound resistance, abrasion resistance or the like.

Such multi-layer fabrics are preferably, for example, those described in JP2014-091307(A) and JP2011-106069(A). That is, it is as follows:

The multi-layer fabric includes at least two layers, an outer layer and an inner layer. In the multi-layer fabric, it is preferable to use a fiber material having high flame retardancy in order to protect the temperature sensor disposed between the layers or on the skin-side surface of the innermost layer of the multi-layer fabric. For example, the limiting oxygen index (LOI) of the fiber constituting the multi-layer fabric is 21 or above, preferably 24 or above. The limiting oxygen index is the oxygen concentration (%) of the atmosphere required to continue combustion, and LOI of 21 or above means that self-extinguishing occurs without continuing combustion in normal air, thereby exerting high heat resistance. In this regard, the limiting oxygen index (LOI) is a value measured by JIS L 1091 (method E).

In this way, high heat resistance may be obtained by using fibers having the limiting oxygen index (LOI) of 21 or above in the outermost layer. The aforementioned fibers include, for example, meta-aramid fibers, para-aramid fibers, polybenzimidazole fibers, polyimide fibers, polyamideimide fibers, polyetherimide fibers, polyarylate fibers, polyparaphenylene benzobisoxazole fibers, novoloid fibers, polychlor fibers, flame retardant acrylic fibers, flame retardant rayon fibers, flame retardant polyester fibers, flame retardant cotton fibers, flame retardant wool fibers, or the like. In particular, it is preferable that the meta-aramid fibers such as polymetaphenylene isophthalamide and the para-aramid fibers such as polyparaphenylene terephthalamide improving the strength of the woven or knitted fabric, or fibers obtained by copolymerizing the aforementioned meta-aramid fibers or para-aramid fibers with the third component are used. An exemplary polyparaphenylene terephthalamide copolymer may be co-poly-(paraphenylene/3,4'-oxydiphenylene terephthalamide) fibers. However, flammable materials such as polyester fibers, polyamide fibers, nylon fibers, and acrylic fibers may be used in combination with the aforementioned fibers as long as flame retardancy is not impaired. Further, the fibers may be raw fibers or post-dye fibers. Further, the woven fabric may be subjected to flame-retarding process, if necessary.

For the above-mentioned fibers, long fibers or short fibers may be used. Further, two or more of the aforementioned fibers may be mixed or blended.

In accordance with the embodiment of the present invention, as the fabric used for the outer layer, the meta-aramid fibers and the para-aramid fibers are preferably used in the form of filaments or blended spun yarns. The spun yarn used may be a single ply or a double ply. The mixing ratio of the para-aramid fibers is preferably 5% by weight or above per a total weight of the fibers constituting the fabric. Because the para-aramid fibers are prone to fibrillation, the mixing ratio of the para-aramid fibers is 60% by weight or below per a total weight of the fibers constituting the fabric.

The fabric may be used in the form of a woven fabric, knitted fabric, nonwoven fabric or the like, but is preferably a woven fabric. As the woven fabric, any woven structure such as plain weave, twill weave, satin weave or the like may be used. In the case of the woven fabric and knitted fabric, two kinds of fibers may be interweaved and interknitted.

The fabric used for the outermost layer (i.e., the outer surface layer) preferably has a fabric weight of 140 to 500 $g/m^2$, more preferably 160 to 400 $g/m^2$, still more preferably 200 to 400 $g/m^2$. If the fabric weight is less than 140 $g/m^2$, sufficient heat resistance may not be obtained. On the other hand, if the fabric weight exceeds 500 $g/m^2$, the feeling of wear as the heat shielding activity garment may be impaired.

In the multi-layer fabric, the inner layer preferably has a tensile modulus of 80 to 800 cN/dtex, a fabric thermal conductivity of 6.0 $W \cdot m^{-1} \cdot k^{-1}$ or below, preferably 5.0 $W \cdot m^{-1} \cdot k^{-1}$ or below and a specific gravity of 3.0 $g/cm^3$ or below. The transmittance of an electromagnetic wave with a wavelength of 800 to 3000 nm is preferably 10% or below, and the fabric weight is preferably 60 to 500 $g/m^2$.

The tensile elastic modulus of the fiber is preferably 80 to 800 cN/dtex (more preferably, 80 to 460 cN/dtex, further preferably 120 to 500 cN/dtex). If the heat shielding activity garment or the like is formed of the fibers with the tensile elastic modulus of less than 80 cN/dtex, depending on the movement and posture of the wearer, the fibers often partly elongate and the fabric becomes thin thereby failing to exert sufficient heat shielding effect. Further, the use of the fibers with the tensile elastic modulus exceeding 800 cN/dtex may have negative effect on the stretch of the resulting heat shielding activity garment or the like. Although this may be avoided by use of the spun yarn, the tensile elastic modulus is preferably 800 cN/dtex or below in terms of the desired effect to be attained.

In the multi-layer fabric, the fabric weight of the fabric is preferably 60 to 500 $g/m^2$ (more preferably 80 to 400 $g/m^2$, still more preferably 100 to 350 $g/m^2$). If the fabric weight is lower than 60 $g/m^2$, the transmission of electromagnetic waves may not be sufficiently prevented in some cases. On the other hand, if the fabric weight is higher than 500 $g/m^2$, the tendency to accumulate heat becomes conspicuous and thus there is a possibility that the heat shielding property is impaired. Also, the light weight property may be impaired.

No particular limitation is imposed on the fibers which constitute the multi-layer fabric. In order to improve the absorption and reflection of electromagnetic waves, metal, carbon, or the like may be kneaded into the fibers or adhered to the surface of the fibers. While the carbon fibers may be used as the aforementioned fibers, the fibers formed of organic polymers, which are hereinafter referred to as organic polymer fibers, may be preferably used including aramid fibers, polybenzimidazole fibers, polyimide fibers, polyamideimide fibers, polyetherimide fibers, polyarylate fibers, polyparaphenylene benzobisoxazole fibers, novoloid fibers, polychlor fibers, flame retardant acrylic fibers, flame retardant rayon fibers, flame retardant polyester fibers, flame retardant cotton fibers, flame retardant wool fibers, etc.

In order to improve the electromagnetic wave absorption and the thermal conductivity of the multi-layer fabric, fine particles of carbon, gold, silver, copper, aluminum or the like may be contained in the organic polymer fibers or adhered to the surfaces of the organic polymer fibers. In this case, carbon or the like may be contained in the organic polymeric fibers or imparted to the surface of the organic polymer fibers as a pigment or paint containing the carbon or the like. The ratio of the contained or adhered fine particles to a total weight of the organic polymer fibers is preferably from 0.05 to 60% by weight, more preferably from 0.05 to 40% by weight, although it depends on the specific gravity of the fine particles. In the case of carbon fine particles, the ratio is preferably 0.05% by weight or above, more preferably 0.05 to 10% by weight, further preferably 0.05 to 5% by weight. Further, in the case of aluminum fine particles, the ratio is preferably 1% by weight or above, more preferably 1 to 20% by weight, further preferably 1 to 10% by weight.

The number average particle diameter of the fine particles is preferably 10 μm or below (more preferably 0.01 to 1 μm).

If the carbon fiber, the metal fiber or the like satisfy the aforementioned requirements such as LOI value and thermal conductivity, it can be used as it is without kneading fine particles thereinto. In particular, as the fibers constituting the inner layer, the fabric with the content of carbon fiber or metal fiber of preferably 50% by weight or above, more preferably 80% by weight or above, further preferably 100% can be preferably used.

Further, the thickness of each layer of the multi-layer fabric greatly affects the heat shielding property. For example, as described in JP2010-255124(A), it is preferable that the thickness of the outer surface layer and the thickness of the inner layer satisfy the following relationship:

$$5.0\ \text{mm} \geq \text{thickness of heat shielding layer (mm)} \geq -29.6 \times (\text{thickness of outer surface layer (mm)}) + 14.1\ (\text{mm})$$

By using the multi-layer fabric containing a high heat shielding property, the temperature sensor, the alarming means, the transmitting means and/or the receiving means which are disposed between the layers or on the skin-side surface of the innermost layer of the multi-layer fabric can be protected from the flame and the alarming signal can be reliably transmitted.

In the multi-layer fabric, the fabric form may be changed from its normal state upon exposure to flames. For example, it is considered that the fabric thickness increases under the exposure to the flame. In this way, the multi-layer fabric which is thin and provides for comfort in the normal state can suppress the increase of the risk for heatstroke, and provides enhanced protection from the flames upon the exposure to the flame. Accordingly, this enables higher levels of safety against both the heatstroke and the flames.

The heat shielding property (HTI) of the fabric constituting the protective suit is preferably 13 seconds or more as measured by the method defined in ISO 9151. As a result, the worker can be protected from the dangers of the flames, and the temperature sensor, the alarming means, the transmitting means and/or the receiving means mounted in the clothes can be protected from the flames thereby enabling them to fulfill their respective functions.

In addition, the water repellency of the fabric constituting the protective suit is preferably Grade 3 or above as measured by the spray method defined in JIS L 1092. As a result, the temperature sensor which is mounted in the protective suit can be protected from water and liquid chemicals to prevent electric leakage and short-circuiting and thus the temperature sensor can function normally. A protective suit with high water resistance and chemical resistance may be obtained by applying a fluorine-based water repellent resin onto the multi-layer fabric in accordance with, for example, a coating method, a spraying method, a dipping method, or the like. In addition, water repellency may be attained by adding a layer with high waterproofness insomuch as that flame retardancy and heat resistance are satisfied.

In the multi-layer fabric, the shrinkage ratio is preferably 5% or below according to the international performance standard ISO 11613-1999 in which the flame resistance, the heat resistance and the washing resistance are applied to the protective suit for firefighting use. Furthermore, it is preferable that the protective suit for firefighting use does not ignite, separate, drop, and melt, according to the international performance standard ISO 11613-1999. Thus, the temperature sensor, the alarming means, the transmitting means and the receiving means which may be disposed inside the protective suit can be protected from the flames and the alarm information can be reliably transmitted.

A moisture permeable and waterproof film may be placed on and secured to a fabric which is formed of the fibers having LOI value of 25 or above. Such a laminated structure functions as an intermediate layer between the outer layer and the inner layer of the multi-layer fabric. Due to the intermediate layer, the permeation of water from the outside can be suppressed while maintaining the comfort of the fabric structure. Accordingly, the above fabric structure is more suitable as the protective suit for firefighters who perform firefighting activities such as water discharge. The fabric weight of the intermediate layer used is preferably in the range of 50 to 200 g/m$^2$. If the fabric weight is less than 50 g/m$^2$, sufficient heat shielding performance may not be obtained. On the other hand, if the fabric weight is greater than 200 g/m$^2$, the weight of the heat shielding activity suit may be too heavy for the wearer and performance may be impaired. A thin film which is formed from polytetrafluoroethylene or the like having moisture permeation and waterproof properties is preferably applied onto the fabric, thereby improving the moisture permeation and waterproofness as well as the chemical resistance. As a result, the evaporation of sweat is promoted and the heat stress of the wearer is reduced. The total weight per unit area of the thin film to be applied to the intermediate layer is preferably in the range of 10 to 50 g/m$^2$. Even when the thin film is applied onto the fabric of the intermediate layer, as described above, the fabric weight of the intermediate layer in which the thin film is applied to the fabric is preferably in the range of 50 to 200 g/m$^2$ as described above.

In addition, a backing layer may be applied onto the inner surface (i.e., the skin-side surface) of the inner layer of the multi-layer fabric taking into consideration practicability such as the touch, wearability and durability of the multi-layer fabric. The fabric weight of the fabric to be used for the backing layer is preferably in the range of 20 to 200 g/m$^2$.

For example, the protective suit may be manufactured by providing the inner and outer layers, with an optional intermediate layer between the inner layer and outer layer, further optionally the backing layer on the inner surface of the inner layer, and sewing them by the known method. Furthermore, the multi-layer fabric in accordance with the embodiment may be manufactured by overlapping the outer and inner layers, attaching fasteners to the layers of the fabric and sewing the layers of the fabric. In this case, due to the fasteners, the layers of the fabric may be separated from each other as required.

By combining the protective suit with the abnormality detection device 2, the first alarming device 3, and the second alarming device 4, the protective suit with the heatstroke alarm system can be obtained.

Here, it is desirable that the abnormality detection device 2, the first alarming device 3, and the second alarming device 4 are arranged on the front body side of the protective suit. By adopting the above arrangement, the activities during the work will not be disturbed, and personal injury as well as the device breakage can be prevented when the worker falls or hits a wall.

As for the arrangement, various methods can be applied as long as the above devices are coupled to the protective suit. For example, the devices may be situated in the pocket during the creation of the pocket, or secured to the protective suit with a string, band, hook and loop fastener, fastener, snap button, adhesive tape, or bracket. Alternatively, the devices and the protective suit may be sewn together. Alternatively, the devices may be attached to the protective suit.

At this time, it is preferable that the abnormality detection device 2 including the temperature sensor is disposed of on the skin-side surface of the innermost layer or between the layers of the multi-layer fabric. This is because the elevation of body temperature as the principal indicator of the onset of heatstroke can be accurately detected.

As described above, the protective suit of the embodiment of the present invention is suitably used as a protective suit for firefighting use (i.e., the fire-fighting garment), but in addition to firefighters, it may also be used for Self-Defense Forces, military personnel, rescue teams, police officers, security guards, workers at construction sites such as construction and civil engineering, etc.

EXAMPLE

Next, examples of the present invention will be described in detail, but the present invention is not limited by these examples. Each measurement in the examples was made by the method described in Table 1.

(1) Fabric Weight

The fabric weight was measured according to JIS L 1096-1990.

(2) Thickness

The thickness was measured using a digimatic thickness tester according to JIS L 096-1990 (woven fabric).

(3) Heat Shielding Property

The time required until the temperature elevation reached 24° C. (HTI24) after exposure to the predefined flame was measured in accordance with ISO 9151. The longer time means a better heat shielding property.

(4) Shrinkage Ratio (Dimensional Change Ratio)

According to ISO 11613, the dimensional change ratio of the fabric before and after exposure to the predefined heat was measured.

(5) Heat Resistance

According to ISO 11613, the fabric was measured as to whether it ignited, separated, dropped or melted after exposure to a predefined heat.

(6) Water Repellency

Water repellency was measured by JIS L1092 (spray method)—1992.

Example 1

According to the Comparative Example 4 of JP2014-091307(A), a multi-layer fabric was obtained and sewn into the shape of a protective suit for firefighting use.

Specifically, for an outmost layer, a woven fabric having a plain weave ripstop structure was manufactured using spun yarns (count: 40/2). The spun yarns were formed of heat-resistant fibers in which polymetaphenylene isophthalamide fibers (CONEX (trademark) manufactured by Teijin Limited) and co-poly-(paraphenylene/3,4'-oxydiphenylene terephthalamide) fibers (TECHNORA (trademark) manufactured by Teijin Limited) were mixed in a ratio of 90:10. The fabric weight of the outer surface layer was 380 g/m$^2$.

For the intermediate layer, a woven fabric (fabric weight: 80 g/m$^2$) having a plain weave structure was manufactured using spun yarns (count: 40/–) and a polytetrafluoroethylene-moisture permeable and waterproof film (manufactured by Japan Gore-Tex Co., Ltd.) was applied to the woven fabric. The spun yarns were formed of heat-resistant fibers in which polymetaphenylene isophthalamide fibers (CONEX (trademark) manufactured by Teijin Limited) and co-poly-(paraphenylene/3,4'-oxydiphenylene terephthalamide) fibers (TECHNORA (trademark) manufactured by Teijin Limited) were mixed in a ratio of 95:5.

For the heat shielding layer, a woven fabric having a plain weave ripstop structure was manufactured using filaments having a total fineness of 1670 dtex which were formed of co-poly-(paraphenylene/3,4'-oxydiphenylene terephthalamide) fiber yarns (TECHNORA (trademark) manufactured by Teijin Limited). The fabric weight of the heat shielding layer (i.e., an inner layer) was 210 g/m$^2$.

A protective suit was obtained by sewing the above multi-layer fabric. The evaluation of the protective suit thus obtained is shown in Table 1.

Next, a unit including an abnormality detection device 2, a unit including a first alarming device 3-1 with a buzzer, and a unit including a first alarming device 3-2 with a light was created. The abnormality detection device 2 was obtained by combining a commercially available unit including a temperature sensor and a transmitting means with a determination means and a controlling means. Wireless communication was established between these devices.

Subsequently, these devices were disposed in a protective suit for firefighting use which included the multi-layer fabric. The abnormality detection device 2, the first alarming device 3-1, and another first alarming device 3-2 were centrally disposed at the right portion of the jacket of the protective suit. Specifically, as shown in FIG. 6, a pocket of the same material as the innermost layer was disposed on the skin-side of the innermost layer, and the abnormality detection device 2 was situated in the pocket. The first alarming device 3-1 was disposed on the weathered side of the outermost layer of the protective suit using a pocket. The other first alarming device 3-2 was situated in a waterproof case and then disposed on the weathered side of the outermost layer of the protective suit using a band. In this way, a protective suit 9 for firefighters was obtained.

Further, a unit including a second alarming device 4 was created. A second alarming device 4 was obtained by combining a commercially available unit including a receiving means and a transmitting means with a small-sized computer. The second alarming device 4 also included a display means for indicating that the temperature sensor, the alarming means, the transmitting means and the receiving means functioned normally. Subsequently, the second alarming device 4 was disposed in a protective suit for firefighting use which included the multi-layer fabric. The second alarming device 4 was centrally disposed at the right portion of the jacket of the protective suit. Specifically, a pocket of the same material as the innermost layer was disposed on the skin-side of the innermost layer, and the second alarming device 4 was situated in the pocket. In this way, a protective suit 10 for a captain of the fire brigade was obtained. The evaluation is shown in Table 1.

The protective suit 9 for firefighters and the protective suit 10 for a captain of the fire brigade allow for alerting to the risk for heatstroke while ensuring safety, workability and convenience.

Example 2

According to Example 6 of JP2014-091307(A), a multi-layer fabric was obtained and sewn into the shape of a protective suit for firefighting use.

Specifically, for an outmost layer, a woven fabric having a plain weave ripstop structure was manufactured using spun yarns (count: 40/2). The spun yarns were formed of heat-resistant fibers in which polymetaphenylene isophthalamide fibers (CONEX (trademark) manufactured by Teijin Limited) and co-poly-(paraphenylene/3,4'-oxydiphenylene terephthalamide) fibers (TECHNORA (trademark) manufactured by Teijin Limited) were mixed in a ratio of 90:10. The fabric weight of the outer surface layer was 380 g/m$^2$.

For the intermediate layer, a woven fabric (fabric weight: 80 g/m$^2$) having a plain weave structure was manufactured using spun yarns (count: 40/–) and a polytetrafluoroethylene-moisture permeable and waterproof film (manufactured by Japan Gore-Tex Co., Ltd.) was applied to the woven fabric. The spun yarns were formed of heat-resistant fibers in which polymetaphenylene isophthalamide fibers (CONEX (trademark) manufactured by Teijin Limited) and co-poly-(paraphenylene/3,4'-oxydiphenylene terephthalamide) fibers (TECHNORA (trademark) manufactured by Teijin Limited) were mixed in a ratio of 95:5.

For the heat shielding layer, aramid fibers containing 1% by weight of carbon particles in co-poly-(paraphenylene/3,4'-oxydiphenylene terephthalamide) fibers were used. Preparation of a polymer solution (i.e., dope) and spinning of the aramid fibers containing carbon black were carried out by the following method.

2,051 g of N-methyl-2-pyrrolidone (hereinafter referred to as NMP) having a moisture content of about 20 ppm was charged into a mixing tank which was equipped with an anchor stirring blade and into which nitrogen flowed. 2764 g of paraphenylene diamine and 5,114 g of 3,4'-diaminodiphenyl ether were precisely weighed, added and dissolved. 10,320 g of terephthalic acid chloride was precisely weighed and added to the diamine solution at a temperature of 30° C. and with stirring rate of 64 revolutions per minute. The temperature of the solution increased to 53° C. due to the heat of the reaction and was then further heated to 85° C. for 60 minutes. Stirring was further continued at 85° C. for 15 minutes to complete the polymerization reaction. The completion of the polymerization reaction was identified by the completion of the viscosity increase of the solution. Thereafter, a 16.8 kg of NMP slurry containing 22.5% by weight of calcium hydroxide was added and stirring was continued for 20 minutes to adjust the pH to 5.4. The dope solution thus obtained was filtered through a filter having an opening of 30 μm resulting in a polymer solution having a polymer concentration of 6% (hereinafter referred to as the dope). The carbon powder "Carbon black FD-0721" manufactured by Dainichiseika Color & Chemicals Mfg. Co., Ltd. was used and the number average particle diameter of the carbon powder was 0.36 μm. The carbon particles were added such that the content thereof per the fibers was 1%.

The addition of carbon black to the fibers was carried out by quantitatively injecting the NMP slurry of carbon black into the above-mentioned dope being fed to the carbon black blended spinning head; immediately subjecting the mixture to dynamic mixing and successively adding 20 or morestaged static mixers; discharging the resulting product through first a metering pump and then a pack/spinning nozzle; collecting the resulting product by dry jet spinning; winding the product having experienced coagulation, drying, hot drawing and finishing with an oil application resulting in co-poly-(paraphenylene/3,4'-oxydiphenylene terephthalamide) fiber yarns. The filament having a total fineness of 1670 dtex was used to fabricate a woven fabric having a plain weave structure. The fabric weight of the inner layer was 210 g/m$^2$. Results are shown in Table 1.

A protective suit was obtained by sewing the above-described multi-layer fabric. The results of the protective suit thus obtained is shown in Table 1.

Next, a unit including an abnormality detection device 2, a unit including a first alarming device 3-1 with a buzzer, and a unit including another first alarming device 3-2 with a light was created. The abnormality detection device 2 was obtained by combining a commercially available unit including a temperature sensor and a transmitting means with a determination means and a controlling means. Wireless communication was established between these devices.

Subsequently, these means were disposed in a protective suit for firefighting use which included the multi-layer fabric. The abnormality detection device 2, the first alarming device 3-1, and the other first alarming device 3-2 were centrally disposed at the right portion of the jacket of the protective suit. Specifically, a pocket of the same material as the innermost layer was disposed on the skin-side of the innermost layer, and the abnormality detection device 2 was situated in the pocket. The first alarming device 3-1 was disposed on the weathered side of the outermost layer of the protective suit using a pocket. The first alarming device 3-2 was situated in a waterproof case and then disposed on the weathered side of the outermost layer of the protective suit using a band. In this way, a protective suit 9 for firefighters was obtained.

Further, a unit including a second alarming device 4 was created. A second alarming device 4 was obtained by combining a commercially available unit including the receiving means and the transmitting means with a small-sized computer. The second alarming device 4 also included a display means for indicating that the temperature sensor, the alarming means, the transmitting means and the receiving means functioned normally. Subsequently, the second alarming device 4 was disposed in a protective suit for firefighting use which included the multi-layer fabric. The second alarming device 4 was centrally disposed at the right portion of the jacket of the protective suit. Specifically, a snap button was attached to the skin-side of the innermost layer, and a counterpart snap button was also attached to the second alarming device 4. The second alarming device 4 was disposed by coupling the snap buttons to each other. In this way, a protective suit 10 for a captain of the fire brigade was obtained.

The protective suit 9 for firefighters and the protective suit 10 for a captain of the fire brigade allow for alerting to the risk for heatstroke while ensuring safety, workability, and convenience.

Example 3

According to Comparative Example 1 of JP2011-106069 (A), a multi-layer fabric was obtained and further sewn into the shape of a protective suit for firefighting use.

Specifically, for an outmost layer, dual weave fabric was used. A plain weave fabric which was manufactured using spun yarns (count: 40/2) was exteriorly arranged and another plan weave fabric which was manufactured using spun yarns (count: 40/–) of 100% co-poly-(paraphenylene/3,4'-oxydiphenylene terephthalamide) fibers (TECHNORA (trademark) manufactured by Teijin Limited) was interiorly arranged. The former spun yarns were formed of heat-resistant fibers in which polymetaphenylene isophthalamide fibers (CONEX (trademark) manufactured by Teijin Limited) and co-poly-(paraphenylene/3,4'-oxydiphenylene terephthalamide) fibers (TECHNORA (trademark) manufactured by Teijin Limited) were mixed in a ratio of 90:10. The two plain weave fabrics were woven to obtain the dual weave fabric for the outmost layer. The outer and inner fabrics were bonded in a lattice pattern with the inner TECHNORA (trademark), and the lattice spacing was 20 mm. The fabric weight of the outer surface layer was 200 g/m$^2$.

For the intermediate layer, a woven fabric (fabric weight: 80 g/m$^2$) having a plain weave structure was manufactured using spun yarns (count: 40/–) and a polytetrafluoroethylene-moisture permeable and waterproof film (manufactured by Japan Gore-Tex Co., Ltd.) was applied to the woven fabric. The spun yarns were formed of heat-resistant fibers in which polymetaphenylene isophthalamide fibers (CONEX (trademark) manufactured by Teijin Limited) and co-poly-(paraphenylene/3,4'-oxydiphenylene terephthalamide) fibers (TECHNORA (trademark) manufactured by Teijin Limited) were mixed in a ratio of 95:5.

For the heat shielding layer, initial spun yarns (yarn 1) (count: 40/–) were firstly formed of heat-resistant fibers in which polymetaphenylene isophthalamide fibers (CONEX (trademark) manufactured by Teijin Limited) and co-poly-(paraphenylene/3,4'-oxydiphenylene terephthalamide) fibers (TECHNORA (trademark) manufactured by Teijin Limited) were mixed in a ratio of 95:5. The initial spun yarns (yarn 1) and one yarn of 56 dtex/12 filaments polyethylene terephthalate fiber (YHY N 800 SSDC manufactured by Teijin Limited) were combined and twisted 500 times in the S direction resulting in a yarn 2. The spun yarn 1 and the yarn 2 were woven with a weaving density of 113 yarns/2.54 cm and a weft of 80 yarns/2.54 cm. For the heat shielding layer, spun yarns 1 (count: 40/–) were firstly formed of heat-resistant fibers in which polymetaphenylene isophthalamide fibers (CONEX (trademark) manufactured by Teijin Limited) and co-poly-(paraphenylene/3,4'-oxydiphenylene terephthalamide) fibers (TECHNORA (trademark) manufactured by Teijin Limited) were mixed in a ratio of 95:5. The spun yarns 1 and one yarn of 56 dtex/12 filaments polyethylene terephthalate fibers (YHY N800SSDC manufactured by Teijin Limited) were combined and twisted 500 times in the S direction resulting in a yarn 2. The spun yarn 1 and the yarn 2 were woven with a weaving density of a warp of 113 yarns/2.54 cm and a weft of 80 yarns/2.54 cm. The resulting woven fabric was subjected to desizing at 80° C. for 1 minute. The resultant fabric was finally subjected to desizing at 180° C. for 1 minute and then used. A protective suit was obtained by sewing the multi-layer fabric. Evaluation is shown in Table 1.

Next, an abnormality detection device 2, a first alarming device 3-1 with a buzzer, and another first alarming device 3-2 with a light were fabricated. The abnormality detection device 2 was obtained by combining a commercially available unit including a temperature sensor and a transmitting means with a determination means and a controlling means. Wireless communication was established between these means.

Subsequently, these means were disposed in a protective suit for firefighting use which includes the multi-layer fabric. The abnormality detection device 2, the first alarming device 3-1, and the first alarming device 3-2 were centrally disposed at the right portion of the jacket of the protective suit. Specifically, a pocket of the same material as the innermost layer was disposed on the skin-side of the innermost layer, and the abnormality detection device 2 was situated in the pocket. The first alarming device 3-1 was disposed on the weathered side of the outermost layer of the protective suit using a pocket. The other first alarming device 3-2 was situated in a waterproof case and then disposed on the weathered side of the outermost layer of the protective suit using a band. In this way, a protective suit 9 for firefighter was obtained.

Further, a second alarming device 4 was created. A second alarming device 4 was obtained by combining a commercially available unit including the receiving means and the transmitting means with a small-sized computer. The second alarming device 4 also included a display means for indicating that the temperature sensor, the alarming means, the transmitting means and the receiving means functioned normally. Subsequently, the second alarming device 4 was disposed in a protective suit for firefighting use which included the multi-layer fabric. The second alarming device 4 was centrally disposed at the right portion of the jacket of the protective suit. Specifically, a hook and loop fastener was attached to the skin-side of the innermost layer, and a counterpart hook and loop fastener was attached to the second alarming device 4. The second alarming device 4 was disposed by coupling the hook and loop fasteners to each other. In this way, a protective suit 10 for a captain of the fire brigade was obtained.

The protective suit 9 for firefighters and the protective suit 10 for a captain of the fire brigade allow for alerting to the risk for heatstroke while ensuring safety, workability and convenience.

Example 4

According to the Comparative Example 4 of JP2014-091307(A), a multi-layer fabric was obtained and sewn into the shape of a protective suit for firefighting use.

Specifically, for an outmost layer, a woven fabric having a plain weave ripstop structure was manufactured using spun yarns (count: 40/2). The spun yarns were formed of heat-resistant fibers in which polymetaphenylene isophthalamide fibers (CONEX(trademark) manufactured by Teijin Limited) and co-poly-(paraphenylene/3,4'-oxydiphenylene terephthalamide) fibers (TECHNORA(trademark) manufactured by Teijin Limited) were mixed in a ratio of 90:10. The fabric weight of the outer surface layer was 380 g/m$^2$.

For the heat shielding layer, a woven fabric having a plain weave structure was manufactured using filaments having a total fineness of 1670 dtex which were formed of co-poly-(paraphenylene/3,4'-oxydiphenylene terephthalamide) fiber yarns (TECHNORA(trademark) manufactured by Teijin Limited). The fabric weight of the heat shielding layer (i.e., an inner layer) was 210 g/m$^2$. Results are shown in Table 1.

A protective suit was obtained by sewing the above multi-layer fabric. The remaining was the same as Example 1. Because the waterproofness of the multi-layer fabric was not sufficient, the interiorly-arranged temperature sensor, the alarming means, the transmitting means and the receiving means became wet from the discharged water. However, in a situation where the equipment does not become wet, the system could normally alert the risk of heatstroke.

TABLE 1

[Industrial applicability]

| | outer layer | | | | intermediate layer | | | inner layer | | | | | protective suit for firefighting use | | |
|---|---|---|---|---|---|---|---|---|---|---|---|---|---|---|---|
| | fabric weight (g/cm2) | weave | shrinkage ratio (%) | heat resistance | fabric weight (g/cm2) | shrinkage ratio (%) | heat resistance | matrix material | fabric weight | weave | shrinkage ratio (%) | heat resistance | total fabric weight (g · cm2) | heat shielding property (HTI24) | water repellency CV |
| Ex. 1 | 380 | plain weave ripstop | <5% | cleared | 120 | <5% | cleared | aramiD | 210 | plain weave | <5% | cleared | 590 | 15.8 | Grade 4 |
| Ex. 2 | 380 | plain weave ripstop | <5% | cleared | 120 | <5% | cleared | aramid/carbon (1%) | 210 | plain weave | <5% | cleared | 590 | 16.5 | Grade 4 |
| Ex. 3 | 205 | dual weave | <5% | cleared | 120 | <5% | cleared | aramid | 290 | dual weave | <5% | cleared | 451 | 20.1 | Grade 4 |
| Ex. 4 | 380 | plain weave ripstop | <5% | cleared | — | — | — | aramid | 210 | plain weave | <5% | cleared | 590 | 15.8 | Grade 2-3 |

The present invention provides protective equipment with an alarm system capable of alarming the danger of heatstroke or the like while ensuring safety, workability, and convenience. Accordingly, the present invention is industrially valuable.

REFERENCE SIGNS LIST

2 abnormality detection device
3 first alarming device
4 second alarming device
7 network
8 server
9 protective suit for firefighters
10 protective suit for a captain in the fire brigade

The invention claimed is:

1. A protective equipment with an alarm system, the alarm system comprising:

(i) a sensor for detecting biometric information of a wearer of the protective equipment;

(ii) a determination means for determining if the biometric information detected by (i) the sensor reaches a threshold value;

(iii) an alarming means for alerting to an elevated risk based on instructions from (ii) the determination means;

(iv) a transmitting means for transmitting an alarm when (iii) the alarming means is activated;

(v) a controlling means for controlling (iii) the alarming means and (iv) the transmitting means; and a display means, wherein at least one of (i) the sensor, (ii) the determination means, (iii) the alarming means, and (iv) the transmitting means has at least one self-diagnosis function means, wherein the display means displays that at least one of (i) the sensor, (ii) the determination means, (iii) the alarming means, and (iv) the transmitting means is operating normally based on a result diagnosed by the self-diagnosis function means.

2. The protective equipment according to claim 1, wherein (i) the sensor is a temperature sensor for detecting an inner temperature of the protective equipment.

3. The protective equipment according to claim 1, wherein (iii) the alarming means is based on a sound.

4. The protective equipment according to claim 1, wherein the protective equipment is formed of a multi-layer fabric including at least an outer layer and an inner layer.

5. The protective equipment according to claim 4, wherein (i) the sensor is disposed on a skin-side surface of an innermost layer or between layers of the multi-layer fabric.

6. The protective equipment according to claim 1, wherein a heat shielding property (Heat-Transfer Index 24) of a fabric constituting the protective equipment is 13 seconds or more as measured in accordance with International Organization for Standardization 9151.

7. The protective equipment according to claim 1, wherein a water repellency of an outermost surface of a fabric constituting the protective equipment is Grade 3 or above as measured by a spray method defined in Japanese Industrial Standard: Category L 1092.

8. The protective equipment according to claim 1, wherein a fabric constituting the protective equipment has a shrinkage ratio of 5% or below according to International Organization for Standardization 11613-1999.

9. The protective equipment according to claim 1, wherein the protective equipment is a protective suit for a firefighting use.

10. The protective equipment according to claim 1, wherein a fabric constituting the protective equipment comprises aramid fibers.

11. A protective equipment with an alarm system, the alarm system comprising:

(A) a receiving means for receiving an alarm which is transmitted by (iv) the transmitting means as recited in claim 1;

(B) an alarming means; and (C) a controlling means for controlling (A) the receiving means and (B) the alarming means.

12. The protective equipment according to claim 11, wherein (B) the alarming means is based on a sound.

13. The protective equipment according to claim 11, further comprising a display means for displaying that at least one of (A) the receiving means, and (B) the alarming means is operating normally.

14. The protective equipment according to claim 11, wherein the protective equipment is formed of a multi-layer fabric including at least an outer layer and an inner layer.

15. The protective equipment according to claim 11, wherein a heat shielding property (Heat-Transfer Index 24) of a fabric constituting the protective equipment is 13 seconds or more as measured in accordance with International Organization for Standardization 9151.

16. The protective equipment according to claim 11, wherein a water repellency of an outermost surface of a fabric constituting the protective equipment is Grade 3 or above as measured by a spray method defined in Japanese Industrial Standard: Category L 1092.

17. The protective equipment according to claim 11, wherein a fabric constituting the protective equipment has a shrinkage ratio of 5% or below according to International Organization for Standardization 11613-1999.

18. The protective equipment according to claim 11, wherein the protective equipment is a protective suit for a firefighting use.

19. The protective equipment according to claim 11, wherein a fabric constituting the protective equipment comprises aramid fibers.

* * * * *